US007338123B2

(12) United States Patent
Buis

(10) Patent No.: US 7,338,123 B2
(45) Date of Patent: Mar. 4, 2008

(54) ERGONOMIC CHAIR

(76) Inventor: Sharon Buis, 157-B Gastlneau, Juneau, AK (US) 99801

( * ) Notice: Subject to any disclaimer, the term of this patent is extended or adjusted under 35 U.S.C. 154(b) by 293 days.

(21) Appl. No.: 11/200,093

(22) Filed: Aug. 10, 2005

(65) Prior Publication Data

US 2005/0269857 A1 Dec. 8, 2005

Related U.S. Application Data

(63) Continuation-in-part of application No. 11/077,602, filed on Mar. 11, 2005, now abandoned.

(60) Provisional application No. 60/553,035, filed on Mar. 15, 2004.

(51) Int. Cl.
*A47C 3/00* (2006.01)
*A47C 7/02* (2006.01)

(52) U.S. Cl. ..... 297/284.4; 297/284.7; 297/452.32; 297/353; 297/344.12

(58) Field of Classification Search ..... 297/353, 297/284.11, 284.4, 452.3, 452.31, 452.32, 297/195.11, 452.29, 423.13, 423.12, 423.11, 297/344.12, 284.7
See application file for complete search history.

(56) References Cited

U.S. PATENT DOCUMENTS 5,295,728 A * 3/1994 Schaevitz ..... 297/195.1
6,123,390 A * 9/2000 Greenwald ..... 297/452.32
6,189,971 B1 2/2001 Witzig
6,394,547 B1 * 5/2002 Vik ..... 297/298

OTHER PUBLICATIONS

Galen Cranz, "The Chair", W.W. Norton Company Inc., 1998.

* cited by examiner

*Primary Examiner*—Milton Nelson, Jr.
(74) *Attorney, Agent, or Firm*—Jeffrey S. Melcher; Manelli Denison & Selter, PLLC

(57) ABSTRACT

An ergonomic chair including a seat support structure with a seat bottom and seat back supported by the seat support structure. The seat bottom is shortened to accommodate the buttocks and ischia, with no weight-bearing on the thighs. The seat back has an upper portion which protrudes forward greater than the lower portion with a sudden transition to provide an innate lumbar support.

14 Claims, 2 Drawing Sheets

ERGONOMIC CHAIR

This application is a Continuation-in-Part of U.S. application Ser. No. 11/077,602, filed Mar. 11, 2005, now abandoned. Which claims the benefit of U.S. application Ser. No. 60/553,035 filed Mar. 15, 2004, the complete disclosures of which are incorporated herein by reference.

FIELD OF THE INVENTION

The present invention relates to chairs and in particular to a task chair to support a user in an ergonomically beneficial manner.

BACKGROUND OF THE INVENTION

Chairs commonly used involve a seat of such length, average 17 inches, but often up to 20 inches or more, such that the user bears weight on the buttocks and ischia as well as the thighs. (When is the last time you considered sitting on your thighs? . . . So, why do we?) Such a design puts pressure on the user's thighs and calves, affecting circulation to the legs and feet, and creating discomfort for the user. The lumbar spine is encouraged into a position of extreme flexion known to create disc pathology, another source of much pain and lost work time.

The user may attempt relief by shifting the hips forward into a sacral sit position in which weight is borne through the apex of the sacrum and through the tailbone. While this position relieves strain on the thighs and calves, it also creates a more extreme flexion strain of the lumbar spine.

An alternate solution often used is the lumbar roll. A look at any anatomical chart or specimen by layman or professional alike reveals an acute angle of the lower lumbar spine at L5-S1. The lordotic angle of the mid to upper lumbar spine is much more gradual. A lumbar roll provides a uniform angle for the whole lumbar spine thus providing either too sharp an angle for the upper and mid lumbar spine or too obtuse an angle for the lower lumbar spine.

Should a user find comfort and good bio-mechanics sitting in a standard task chair, yet remains the difficulty in sustaining it while working at a desk. In a standard task chair it is necessary to lean forward to work at a desk thus losing the benefit of the lumbar support available. This option places the user's upper body in a position of strain contributing to headaches, shoulder, neck and mid-back pain, and double crush injuries contributing to carpal tunnel syndrome. The user may alternately choose to sit at the edge of the chair abandoning the lumbar support altogether. Most users lack the ability to sustain an unsupported upright position for any prolonged period thus leaving the user's upper body in a position of strain such as previously described.

Any attempt to modify seating as we know it, should take into consideration the social value of the chair. Sitting in a chair is valued as an adult and civilized behavior in Western societies. The boss sits in a wide chair with a high back, often of leather while supportive staff sit in low backed chairs, which are narrower and usually not of leather. (Ref. "The Chair" by Galen Cranz, W.W. Norton Company Inc, 1998) To remove these options in seating by using a stool, a kneeling chair, or a saddle, a users value system and expectations are compromised.

There is a need for a chair that maintains the expected social variations while providing any user with an anatomically supportive, ergonomic seating position.

SUMMARY OF THE INVENTION

An objective of the present invention is to provide an ergonomic chair that alleviates back and neck problems associated with conventional chairs.

Another objective of the present invention is to provide an ergonomic chair that maintains the expected social variations.

These objectives are obtained by an ergonomic chair comprising:

- a seat back having a superior portion and an inferior portion, the superior portion protruding forward greater than an inferior portion, a seat back transition being located where the inferior and superior portions meet, the inferior portion providing an acute angle to support for a user's lower lumbar spine and the superior portion providing a graduated angle to support the user's mid to upper lumbar spine;
- a seat bottom operatively associated with the seat back, said seat bottom being constructed and sized to support the user's ischia and buttocks with no weightbearing through the user's thighs when the user is in a sitting position on the seat bottom with the user's back being fully against the seat back; and
- a seat post and base constructed and arranged supporting the seat bottom and seat back at a height such that when the user is sitting in the chair the user's thighs are in a range of from about horizontal to about 20 degrees below horizontal.

The objectives are also met by a method of providing an ergonomic chair to a user comprising:

- measuring a user's buttock and leg size;
- providing an ergonomic chair having a seat bottom and a seat back, wherein the seat bottom has a length such that the seat bottom supports the user's ischia and buttocks with no weightbearing through thighs when a user is in a sitting position on the seat bottom with the user's back being fully against the seat back; and
- providing a height of the chair such that when the user is sitting in the chair the user's thighs are in a range of from about horizontal to about 20 degrees below horizontal

DETAILED DESCRIPTION OF PREFERRED EMBODIMENTS

Figure 1A:
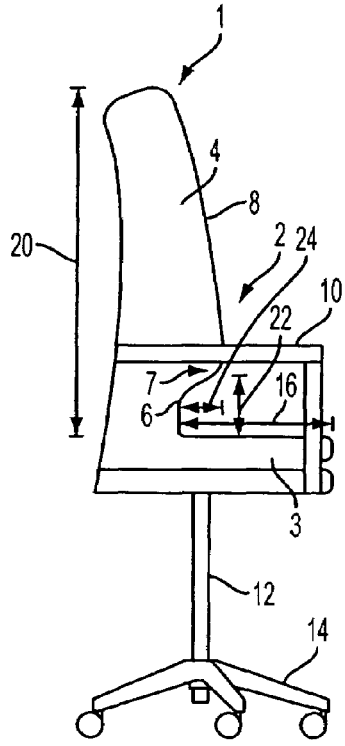
FIGS. 1A and 1B illustrates side views of ergonomic chairs according to the present invention.

The present invention will be explained with reference to the attached FIGS. without being limited thereto. FIG. 1A illustrates an ergonomic chair 1 which relieves the user of many of the common maladies of seating. This is achieved through the use of a seat 2 having a shortened seat bottom 3 and a transitional seat back 4 having an inferior portion 6 providing an acute angle to support the lower lumbar spine and a superior portion 8 providing a graduated angle to support the mid to upper lumbar spine. Together these characteristics provide an innate lumbar support. This accommodation to the natural curves of the spine in combination with a shortened seat bottom 3 allows the user greater comfort and decreased lumbar strain than standard task chairs. Furthermore, shortened arm rests 10, if present, allow the user to work at a desk without leaning forward thus the benefit of the lumbar support is maintained while working. Stress on the upper body is reduced by a more upright working position.

The chair 1 provides relief for all of the above common seating maladies. The shortened seat bottom 3 removes pressure from the thighs. Circulation is not compromised and the user is not encouraged into lumbar flexion by pressure on the posterior thigh. The user is relieved of the need or option of sacral sitting by the shortened seat.

The chair 1 includes a seat post 12 and base 14 for supporting the seat 2. The seat post 12 and base 14 are selected to provide the chair 1 with a height such that the user's thighs are in a range of from about horizontal, i.e. parallel to the ground, to about 20 degrees below horizontal, when the user's feet are flat on the floor. The final position within this range is to be determined by user preference and comfort. The five-wheeled base 14 is only shown as an example and any suitable base 14 can be utilized.

The seat bottom 3 is preferably about 10 to about 14 inches (shown at 16), and most preferably about 12 to about 13 inches, to ensure that only the user's ischia and buttocks are supported by the seat bottom 3 with no weightbearing through the thighs when the user is in a sitting position on the seat bottom 3 with the user's back being fully against the seat back 4. The seat bottom width can be any size as required for the particular user.

A seat back transition 7 is defined where the inferior portion 6 meets the superior portion 8. Preferably, the transition 7 is sudden to conform to the user's spine at L5-S1 lumbar.

The height of the seat back 4 relative to the seat bottom 3 is set such that the seat back transition 7 supports the lumbar lordosis. Preferably, the edge of the transition 7 is set at L5-S1 for the particular user. The height of the transition 7 to the seat bottom 3 is shown at 22. The height 22 usually ranges from about 4 to about 10 inches, with most users being the range of about 6 to about 8 inches. The depth 24 of the inferior portion 6 compared to the superior portion 8 is usually about 1 to about 4 inches, preferably about 1 to about 2 inches, with about 1.5 inches being most preferred.

The arm rests 10, if present, are set such the weight of the arms in a resting position are supported by the arm rests. The arm rests 10 can be connected to the seat bottom 3 and/or seat back 4 directly or indirectly via any other support structure as desired.

The seat back 4 can be set at any height as desired, shown at 20. Preferably, the seat back 4 height is about 10 to about 36 inches, with the ideal height dependent upon user preference.

The angle of the seat back 4 is preferably from vertical to about 5 degrees back slant from the seat back transition 7 superiorly. Vertical is most preferred to avoid a forward head posture and related cervical, thoracic and related myalgias.

Figure 1B:
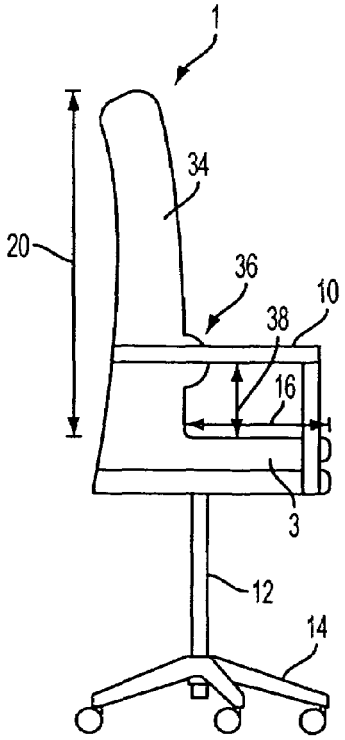

If desired, while not preferred, the transition seat back 4 may be replaced with a seat back 34 having a lumbar roll 36 to provide lumbar support as shown in FIG. 1B. The height 38 of the lumbar roll 36 should be such that the lower lumbar spine of a user is supported in a position of extension.

A particularly preferred transitional seat back 4 has a height of 16.5 inches, a transition 7 of 4 inches in height shown at 4 and 1.5 inches in depth shown at 24, and a seat length 8 of 12 inches.

Figure 2:
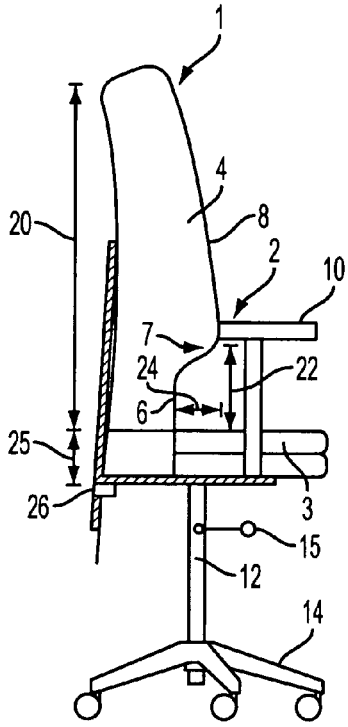
FIG. 2 illustrates a side view of an ergonomic chair according to the present invention having an adjustable height seat back transition.
Figure 3:
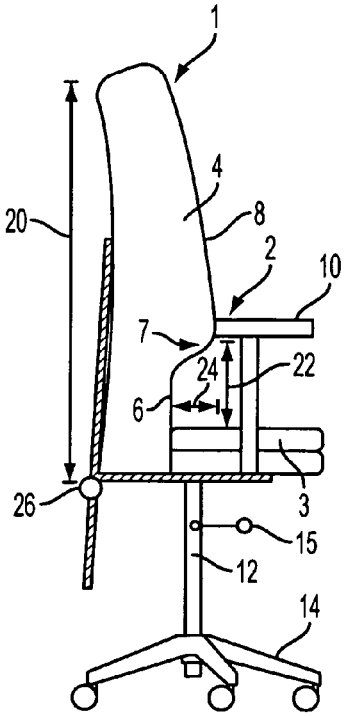
FIG. 3 illustrates a side view of an ergonomic chair according to the present invention having an adjustable height seat back transition.

FIGS. 2 and 3 illustrate an adjustable chair 1. The seat height is adjustable using and adjustable seat post 12 and adjustment lever 15, to provide a seat height such that the user's thighs are in a range of from about horizontal, i.e. parallel to the ground, to about 20 degrees below horizontal, when the user's feet are flat on the floor.

The inferior portion 6 has a height 22 selected to support the lower spine of a user. Preferably, the height 22 is in the range of about 4 to about 10 inches, to accommodate different buttocks sizes. The height 22 is measured from the seat bottom 3 to the transition 7. The seat back 4 is adjustable in height using the adjustment structure 26. This variable seat back 4 height option allows a large user to raise the seat back 4 so the lumbar support is 10 inches above the seat bottom 3 and a smaller user can lower the seat back 4 so it is 4 inches above the seat bottom 3. The average user is in the range of 6 to 8 inches. FIG. 3 shows the seat back 4 in a lowered position and FIG. 2 show the seat back 4 in a raised position with a gap 25.

If a lumbar roll 36 is used as shown in FIG. 1B, the lumbar roll 36 may be adjustable in height or the seat back 34 adjustable in height.

Chair frame construction may be of any commonly used materials, such as plastic, metal or wood. To accommodate a variable seat back height, two separate pieces are required, one for the seat back and one for the seat bottom. This is not an uncommon chair structure, but varies from the solid plastic frame commonly used for task chairs.

Details on materials and manufacture are not included herein as they are well known in the art. The technology and products used in making the chair 1 are not modified from the standards and methods for conventional chair-making. The construction of the ergonomic chair 1 are provided for herein and based on these teachings, one of ordinary skill in the art will be able to modify the chair 1 to accommodate different size users as desired, without undue experimentation. The modifications are applied to task chairs, but can be applied to any kind of seating device.

The invention also provides a method of providing an ergonomic chair 1 to a user. The users body dimensions are first measured, including back, legs and buttocks. The seat height is adjusted such that the inferior portion 6 supports the lower lumbar spine and the superior portion 8 supports the mid to upper lumbar spine. The length of the seat bottom 3 is selected to only support the user's ischia and buttocks with no weightbearing through the thighs when the user is in a sitting position on the seat bottom 3 with the user's back being fully against the seat back 4. The seat height is adjusted to a height such that when a user is sitting in the chair 1 the user's thighs are in a range of from about horizontal to about 20 degrees below horizontal.

While the claimed invention has been described in detail and with reference to specific embodiments thereof, it will be apparent to one of ordinary skill in the art that various changes and modifications can be made to the claimed invention without departing from the spirit and scope thereof.

What is claimed is:

1. An ergonomic chair comprising:

a seat back having a superior portion and an inferior portion, the superior portion protruding forward greater than the inferior portion, a seat back transition being located where the inferior and superior portions meet, the inferior portion providing an acute angle to support a user's lower lumbar spine and the superior portion providing a graduated angle to support the user's mid to upper lumbar spine, wherein an angle of the seat back is from vertical to about 5 degrees back slant from the seat back transition to avoid a forward head posture;

a seat bottom operatively associated with the seat back, said seat bottom being constructed and sized to support the user's ischia and buttocks with no weightbearing through the user's thighs when the user is in a sitting position on the seat bottom with the user's back being fully against the seat back, wherein the seat bottom has a length of about 10 to about 14 inches; and a seat post and base constructed and arranged supporting the seat bottom and seat back at a height such that when the user is sitting in the chair the user's thighs are in a range of from about horizontal to about 20 degrees below horizontal.

2. The ergonomic chair according to claim 1, further comprising arm rests operatively associated with at least one of the seat back or seat bottom, the arm rests having a length equal to or less than a length of the seat bottom.

3. The ergonomic chair according to claim 1, wherein the seat back transition is about 4 to about 10 inches higher than the seat bottom.

4. The ergonomic chair according to claim 1, wherein the seat back transition is about 6 to about 8 inches higher than the seat bottom.

5. The ergonomic chair according to claim 1, wherein the depth of the inferior portion compared to the superior portion is about 1 to about 4 inches.

6. The ergonomic chair according to claim 1, wherein the depth of the inferior portion compared to the superior portion is about 1 to about 2 inches.

7. The ergonomic chair according to claim 1, wherein the depth of the inferior portion compared to the superior portion is about 1.5 inches.

8. The ergonomic chair according to claim 1, further comprising a seat back having a lumbar roll to support a user's lumbar spine.

9. The ergonomic chair according to claim 1, wherein the seat bottom has a length of about 12 to about 13 inches.

10. The ergonomic chair according to claim 1, wherein the seat bottom has a length of about 12 inches.

11. The ergonomic chair according to claim 1, wherein the seat back is adjustable in height compared to the seat bottom.

12. The ergonomic chair according to claim 1, wherein the seat post is adjustable in height.

13. A method of providing an ergonomic chair to a user comprising:

measuring a user's buttock and leg length;

providing an ergonomic chair having a seat bottom and a seat back, wherein the seat bottom has a length such that the seat bottom supports the user's ischia and buttocks with no weightbearing through thighs when a user is in a sitting position on the seat bottom with the user's back being fully against the seat back; and providing a height of the chair such that when the user is sitting in the chair the user's thighs are in a range of from about horizontal to about 20 degrees below horizontal, wherein the seat back has a superior portion and an inferior portion, the superior portion protruding forward greater than an inferior portion, a seat back transition being located where the inferior and superior portions meet, the method further comprising providing a seat transition height such that the inferior portion supports the user's lower lumbar spine and the superior portion supports the user's mid to upper lumbar spine.

14. The method according to claim 13, wherein the seat back has a lumbar roll and the method further comprises adjusting the height of the seat back or lumbar roll to provide lumbar support to the user.

* * * * *